United States Patent [19]

Koller et al.

[11] Patent Number: 4,909,297

[45] Date of Patent: Mar. 20, 1990

[54] HARDWARE FOR READY-MADE BALLOON SHADE

[75] Inventors: Barbara Koller, New York, N.Y.; Ervin Miles, Yanceyville, N.C.; Anthony T. Solomon, Reidsville, N.C.

[73] Assignee: Burlington Industries, Inc., Greensboro, N.C.

[21] Appl. No.: 677,488

[22] Filed: Dec. 3, 1984

[51] Int. Cl.[4] ..... E06B 3/94

[52] U.S. Cl. ..... 160/84.1; 160/330

[58] Field of Search ..... 160/84 R, 330, 344, 160/345, 346

[56] References Cited

U.S. PATENT DOCUMENTS

| | | | |
|---|---|---|---|
| 978,220 | 12/1910 | Sarkisian | 160/84 |
| 1,084,781 | 1/1914 | Behrle . | |
| 1,321,800 | 11/1919 | Andress et al. . | |
| 1,494,429 | 5/1924 | Kirsch | 160/345 |
| 1,525,153 | 2/1925 | Sarkisian | 160/344 X |
| 1,945,228 | 1/1934 | Nudelman et al. | 160/345 X |
| 2,051,342 | 8/1936 | Nudelman et al. | 160/345 |
| 2,110,983 | 3/1938 | Carver | 160/84 R |
| 2,295,137 | 9/1942 | Sutton | 160/84 |
| 3,013,604 | 12/1961 | Roberts | 160/344 |
| 3,142,858 | 8/1964 | Bieda . | |
| 3,160,202 | 12/1964 | Rosen | 160/84 |
| 3,248,749 | 5/1966 | Williams . | |
| 3,312,273 | 4/1967 | Adam et al. . | |
| 3,322,182 | 5/1967 | Palella . | |
| 3,361,190 | 1/1968 | Snyder . | |
| 3,437,127 | 4/1969 | Lukashok | 160/330 |
| 3,439,725 | 4/1969 | Haimonvitz et al. | 160/84 R |
| 3,528,477 | 9/1970 | Abraham . | |
| 3,713,473 | 1/1973 | Ford | 160/345 |
| 3,952,788 | 4/1976 | Scholer . | |

*Primary Examiner*—David M. Purol

*Attorney, Agent, or Firm*—Nixon & Vanderhye

[57] ABSTRACT

A curtain, drape, shade, or the like movable to a position in which it has a ballooning effect is mounted in a simple and effective manner. A first conventional curtain rod supports a fabric sheet comprising the shade, or the like, at a top portion of the sheet. A second conventional curtain rod is spaced from the first rod and is adjacent the top of the sheet. A number of rings, disposed in columns, are formed on the back of the fabric sheet, and a cord passes through all the rings in a column. Each cord is connected at a first end to a bottom portion of the fabric sheet, and the second end of each cord passes through one or more eyelets mounted in a fixed position with respect to the second curtain rod. Each eyelet may be moved to any desired position along the curtain rod by loosening a screw fastener, and when the screw fastener is tightened it is fixed at the particular position to which it has been moved along the curtain rod.

16 Claims, 3 Drawing Sheets

Fig. 1.
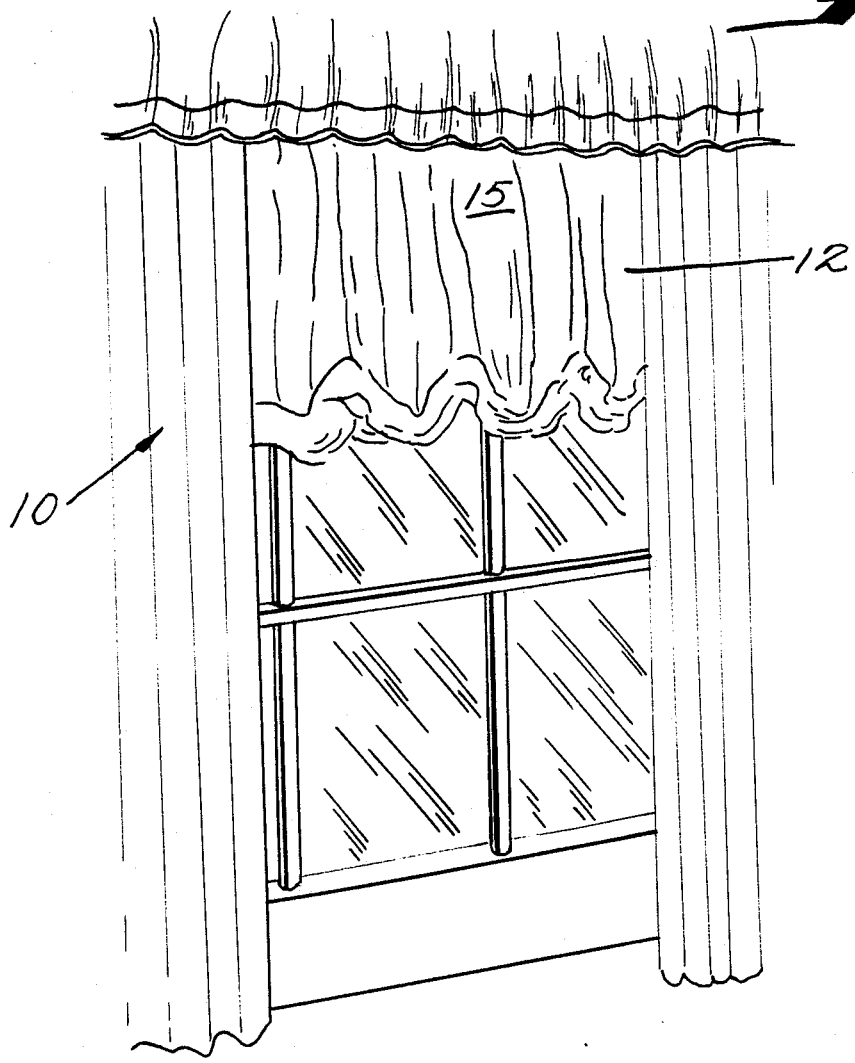
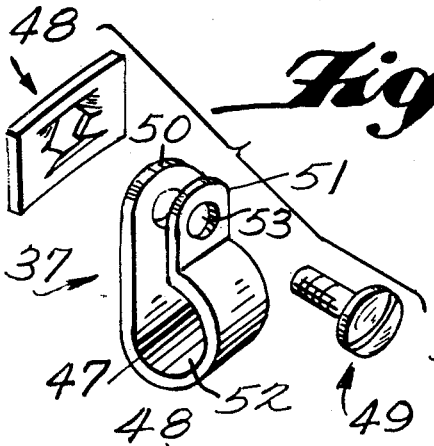
Fig. 3.
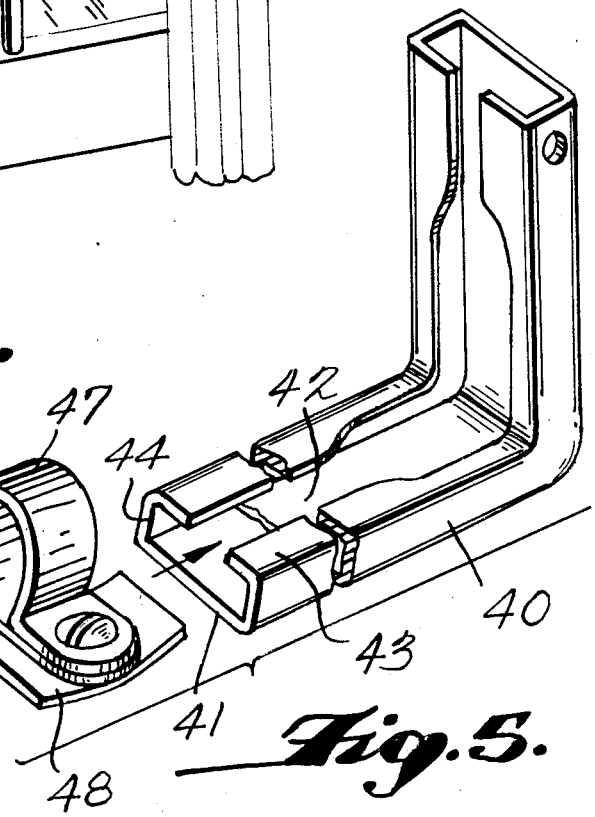
Fig. 5.
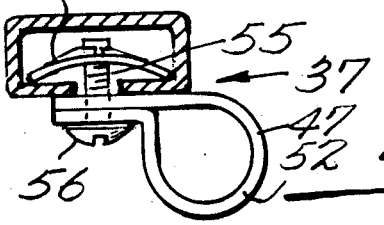
Fig. 4.

Fig. 2.
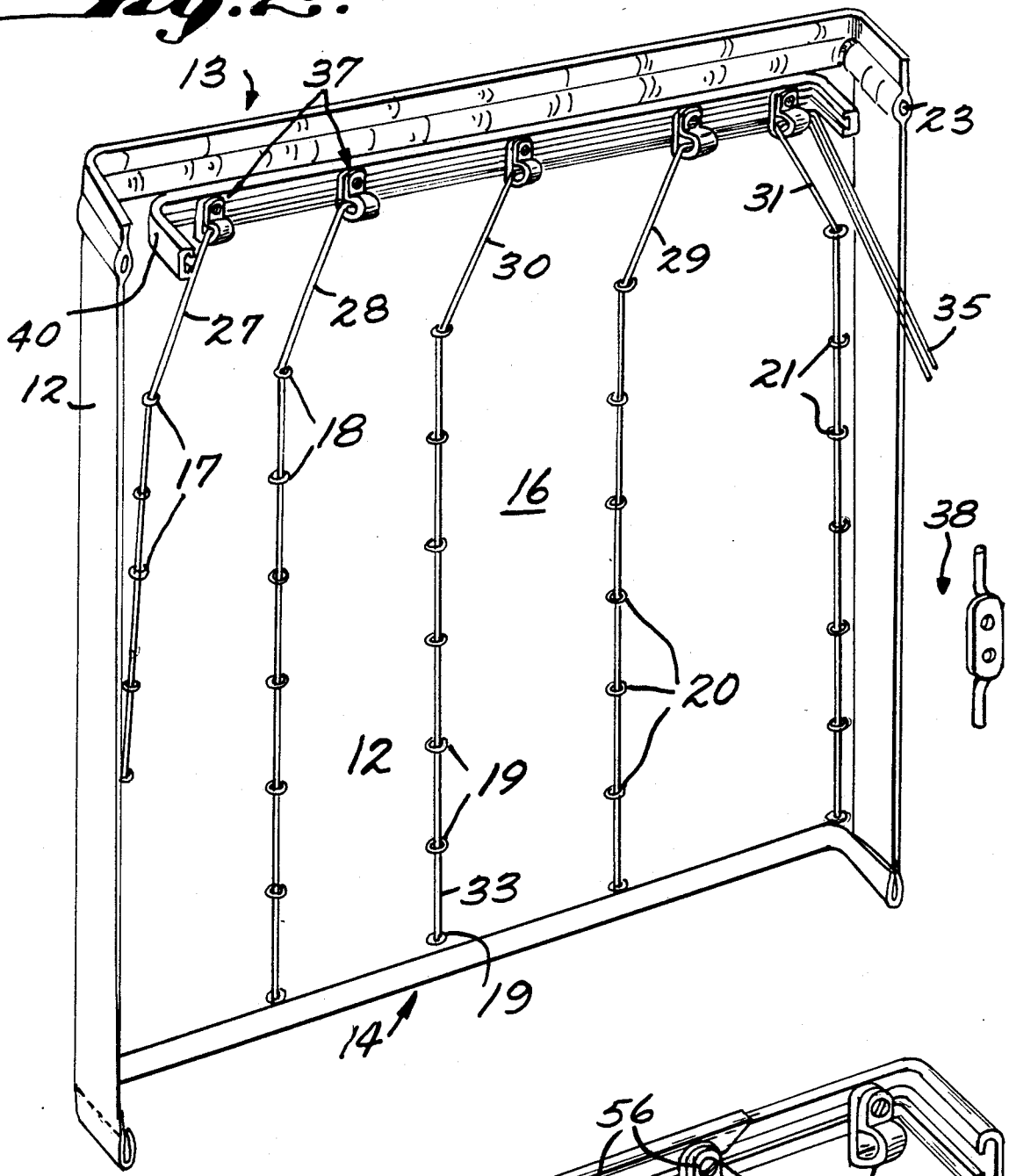
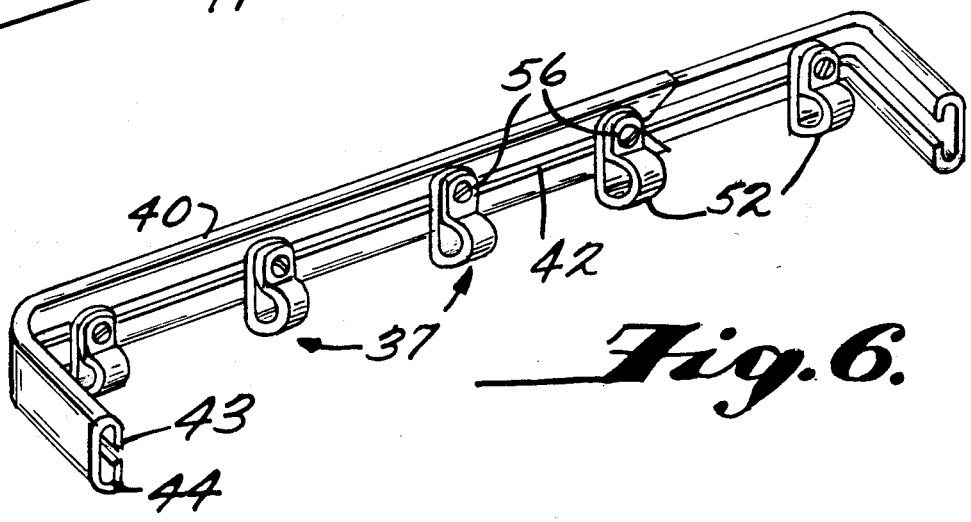
Fig. 6.

HARDWARE FOR READY-MADE BALLOON SHADE

BACKGROUND AND SUMMARY OF THE INVENTION

Shades, curtains, drapes, or the like, having a ballooning effect can provide a very desirable treatment for windows, sliding glass doors, and the like. Conventional hardware associated with such shades, curtains, or draperies include a board onto which a number of eye hooks are attached. The board is mounted adjacent the top of the window or door with which the shade, curtain, or drape is to be associated, and pull cords passing through eyelets formed on the back of the shade, or the like, pass through the eye hooks. While such a structure is successful in accomplishing the desired ballooning effect, it is a relatively complex, cumbersome, and complicated structure.

According to the present invention, a balloon shade (curtain, drape or the like) assembly is provided which is simplified compared to the common commercial prior art structures. The assembly according to the present invention includes a conventional rod in place of the wooden board. A number of eyelet means are associated with the curtain rod, and may be affixed to the curtain rod at desired selected positions along the curtain rod. These eyelet means receive the pull cords in the same manner that the eye hooks receive the pull cords in conventional assemblies.

Each of the eyelet means preferably includes an eyelet forming body member, a holding member, and a fastener means. The fastener means operatively attached the body member and the holding member to the curtain rod in a selected position to which they have been moved along the curtain rod.

The eyelet forming body member and the holding member are preferably distinct portions of an integral body, which preferably is made of plastic. The holding member comprises a hollow member having an interior hollow opening having basically the same cross-sectional shape and dimensions as the curtain rod, and adapted to slide as a sleeve over the curtain rod. The eyelet forming body member is an extension of the sleeve, extending outwardly from one side thereof, and including an opening through which the cord passes. The fastener means preferably comprises a screw which screws through a wall of the holding member to operatively frictionally engage the curtain rod to hold the body member and the holding member in the selected position to which they have been moved along the curtain rod.

Alternatively, the eyelet forming body member may comprise an integral piece of plastic having aligned free ends with means defining aligned openings in the free ends, and a looped central portion. The holding means then comprises a sheet metal nut of rectangular shape, and curved about an axis through a central portion thereof, a sheet metal nut disposed within an interior volume defined by the curtain rod. The fastener means then comprises a screw which passes through the aligned openings in the free ends of the eyelet body member, and into operative engagement with the sheet metal nut. When the screw is loosened the eyelet may be moved to any desired position along the curtain rod, and when the screw is tightened down the eyelet is fixed in place along the curtain rod.

It is the primary object of the present invention to provide a simple yet effective mechanism for hanging a balloon shade, curtain, drape, or the like. This and other objects of the invention will become clear from an inspection of the detailed description of the drawings, and from the appended claims.

BRIEF DESCRIPTION OF THE DRAWINGS

FIG. 1 is a front perspective view of an exemplary balloon shade assembly according to the present invention shown in a position wherein it has a ballooning effect, and shown in operative association with a window;

FIG. 2 is a rear perspective view of the assembly of FIG. 1;

FIG. 3 is a perspective exploded view of exemplary eyelet means according to the present invention;

FIG. 4 is a side assembly view of the eyelet means of FIG. 3;

FIG. 5 is a perspective view of the eyelet means of FIGS. 3 and 4 in relationship to a conventional curtain rod with which it is to be associated;

FIG. 6 is a perspective view of a conventional curtain rod having a plurality of eyelet means according to the invention disposed at predetermined positions along the length thereof;

DETAILED DESCRIPTION OF THE DRAWINGS

Figure 7:
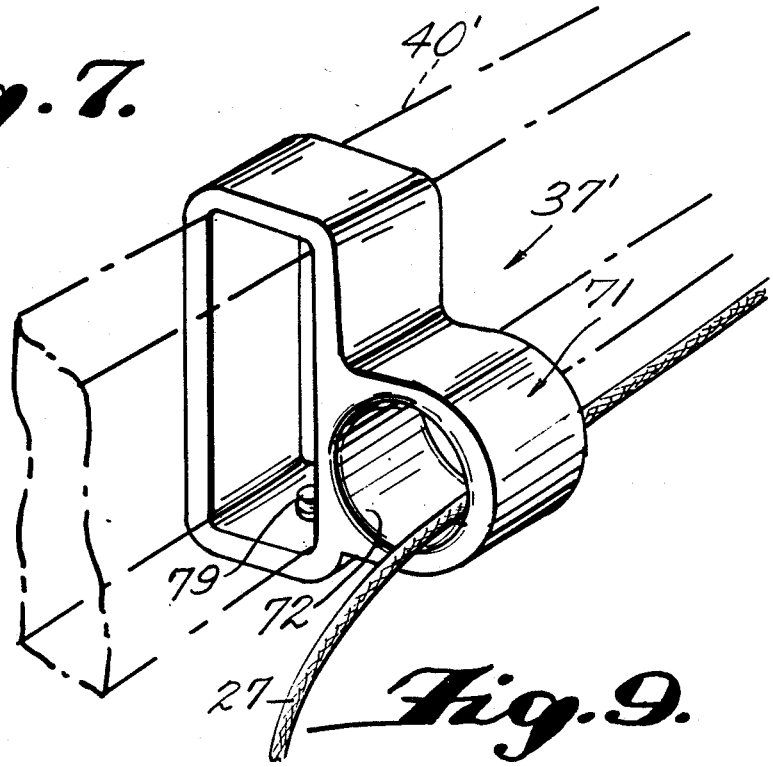
FIG. 7 is a perspective view of another embodiment of eyelet, holding, and fastening means for use with a wide variety of different types of curtain rods.

In the following description reference will be made to a ballooning "shade", for convenience of description. However it is to be understood that the structure designated as a "shade" may be, or may be considered, as a curtain, drape, or the like.

A conventional ballooning shade in a position wherein it has a ballooning effect is illustrated generally by reference numeral 10 in FIG. 1. The same shade 10 is illustrated in FIG. 2 wherein it is in a position where it does not have a ballooning effect.

The shade 10 comprises a fabric sheet 12 having a top portion 13, bottom portion 14, front 15 (see FIG. 1), and back 16 (see FIG. 2). As is conventional for ballooning shades, along the back 16 a plurality of rings are disposed in columns. For instance rings 17 are disposed in one column, rings 18 in another, and so forth for rings 19–21.

At the top portion 13 of the shade 12, there are means formed for attaching the shade to a fixed horizontal support. For the embodiment illustrated in FIG. 2, the fixed top horizontal support comprises a conventional first curtain rod 23 which is received within a channel formed between overlapping top portions of the shade 12.

Associated with the rings 17–21 are a plurality of pull cords 27–31, respectively. Each pull cord 27–31 is operatively connected at a first end thereof to the bottom portion 14 of the shade 12. For instance as shown with respect to the cord 29, the first end 33 thereof is looped through the bottom ring 19 and then tied in a knot to an intermediate portion of the cord 29, but adjacent the end 33 thereof. To accentuate the ballooning effect, a number of the rings adjacent the bottom 14 of the shade 12 may be tied together utilizing small pieces of cord, or the free end 33 could be tied to an intermediate portion of the cord 29 up above several of the rings 19 (and the same would be true with respect to each of the cords 27, 28, 30, and 31 too). Each of the cords 27–31 also has a second end portion thereof, the second end portions ultimately coming together in close proximity to each other and being shown collectively by the reference numeral 35 in FIG. 2. Each of the cords 27–31 passes through one or more of the eyelet means 37 according to the present invention, as will be hereinafter described, and when a pulling force is exerted on the collective ends 35 the shade 12 will move from the position illustrated in FIG. 2 to the position illustrated in FIG. 1, the bottom portion 14 moving toward the top portion 13 and a ballooning effect taking place. When the desired position of the shade 12 has been reached, the cords 27–31, adjacent the collective ends 35 thereof, may be tied to a conventional cleat 38 (see FIG. 2) which is affixed to the window frame, door frame, or like structure that is stationary with respect to the curtain rod 23.

With particular reference to FIGS. 3 through 6, one exemplary form of the eyelet means 37 according to the present invention is illustrated associated with a second conventional curtain rod 40. The curtain rod 40, in this case, includes a front wall 41, a back wall having means defining the elongated slot 42 therein (the slot 42 elongated in the same dimension of elongation as the elongated tubular member comprising the curtain rod 40), and an interior volume between the back wall and the front wall 41. The back wall includes a front surface 43, and a back surface 44 (see FIGS. 5 and 6), and the front wall 41 is spaced from the surface 44.

As seen most clearly in FIGS. 3 through 5, the eyelet means 37 includes an eyelet forming body member 47, a holding member 48, and fastener means 49. The body member 47 preferably is an integral piece of material, such as a plastic, having first and second end portions 50, 51 thereof which are in alignment, and a looped central portion 52 which actually forms the "eye" through which the cord or cords 27–31 will pass. Formed in the end portions 50, 51 are aligned openings (see opening 53 in FIG. 3) through which the fastener 49 passes. The member 47 is adapted in use (see FIGS. 2 and 6) to be disposed exteriorly of the interior volume of the second curtain rod 40, and in engagement with the front surface 43 of the back wall of the curtain rod 40.

The holding member 48 preferably comprises, as illustrated, a sheet metal nut which has a rectangular shape and is curved about an axis through a central portion thereof (as is most clear from FIG. 4). The sheet metal nut 48 includes a central opening which receives the fastener 49, which comprises a screw fastener having a threaded shank 55 which passes through the openings 53 and into operative association with the central opening in the nut 48. The screw fastener 49 also includes head 56 which may be engaged by a conventional screwdriver. The nut 48 is adapted to be disposed within the interior volume of the curtain 40, and engage the back surface 44 of the back wall thereof.

The eyelet means 37 are moved into operative association with the second curtain rod 40 by inserting one edge of the nut 48 into the open end of the smaller section of the second curtain rod 40 (the right hand section in FIGS. 2 and 6), as illustrated in FIG. 5. Depending upon the width of the internal volume of the curtain rod 40, either the small edge of the rectangular nut 48, or the large edge of the rectangular nut 48, will be inserted. In the FIG. 5 embodiment, the width of the interior volume of the second curtain rod 40 is such that the smaller edge of the nut 40 is inserted. Also, care is taken to ensure that the nut 48 curves toward the surface 44, so that it will engage it when tightened down (see FIGS. 4 and 5 in particular).

After all the eyelets 37 are inserted into operative association with the smaller section of the curtain rod 40, the sections of the curtain rod 40 as assembled together and the eyelets 37 are slid along the length of the slot 42 to the desired locations (i.e. in alignment with the columns of eyelets 17–21). Then each of the eyelets 37 is affixed in place by inserting a screwdriver blade into operative association with the slotted head 56 of the screw 49, and tightening the screw, which causes the eyelet body member 47 to press tightly against the curtain rod surface 43, and causes the edges of the curved surface of the nut 48 to press tightly against the curtain rod surface 44.

Figure 8:
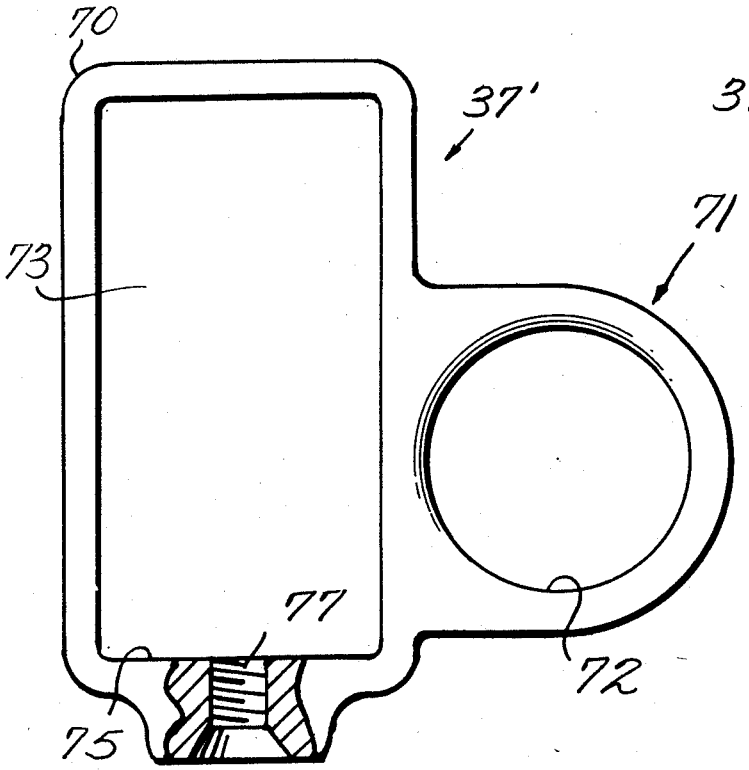
FIG. 8 is a side exploded view of the device of FIG. 7.
Figure 9:
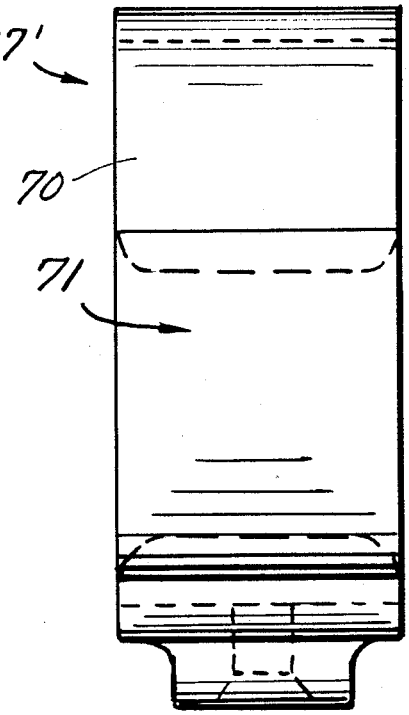
FIG. 9 is a front view of the device of FIG. 7 with the fastener removed.
Figure 9:
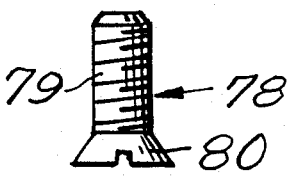

FIGS. 7 through 9 illustrate another embodiment of the eyelet according to the present invention. In this embodiment each eyelet 37′ is particularly adapted to be used on a wide variety of different types of conventional curtain rods whether or not they have an elongated slot (such as the slot 42) therein. For instance the curtain rod 40′ illustrated in FIG. 7 while having a cross-sectional shape and dimensions generally comparable to the curtain rod 40 illustrated in FIGS. 2, 3, and 6, has solid front, back, top, and bottom walls; i.e. no slot is provided therein. The eyelet 37′ can be used with either the curtain rods 40, or 40′, and by varying the internal shape and dimensions of the holding member 70, can fit other types of curtain rods.

The eyelet 37′ includes an eyelet forming body member 71, which has a through-extending eye 72 through which a cord (e.g. cord 27) passes. While the body member 71 is distinct from the holding member 70, preferably the holding member 70 and the body member 71 are formed with an integral piece of plastic. The holding member 70 comprises a substantially circumferentially continuous member having a through-extending cavity 73 therein which has a shape corresponding to the shape of the curtain rod 40, 40′, and has dimensions slightly greater than the dimensions of the curtain rod 40, 40′ so as to slide as a sleeve thereover.

Formed in one wall of the holding member 70, preferably the bottom wall 75 thereof, is a screw threaded opening 77 extending generally perpendicular to the wall 75. The fastener means preferably comprises a screw 78 having a shank portion 79 which is exteriorly threaded to engage the interior threads of the opening 77, and having a slotted head 80. The screw 78 when passing through the wall 75 into the cavity 73 (see FIG. 7) fictionally engages the bottom of the curtain rod 40′, 40 to hold the eyelet 37′ in a selected position to which it has been moved along the curtain rod.

OPERATION

In an exemplary manner of utilization and operation of the assembly 10 according to the present invention, the first curtain rod 23 is moved into operative association with a receiving means therefor at the top portion 13 of the sheet 12, and the first curtain rod 23 is mounted on conventional supports so that it is substantially horizontal and supports the sheet 12 in the manner illustrated in FIG. 2. If the cords 27–31 are not already in place with respect to the eyelets 17–21, each of the cords 27–31 is tied to the bottom eyelet of each of the columns of eyelets 17–21, is threaded through all of the rings in its associated column of rings, and the second ends of the cords are then free, and adjacent the top portion 13 of the sheet 12.

With reference to the FIGS. 2–6 embodiment, the eyelet means 37 are moved into operative association with the second curtain rod, in the manner illustrated in FIG. 5, and after the right and left hand portions of the second curtain rod 40 are assembled the second curtain rod 40 is mounted by conventional supports so that it is generally horizontally disposed, preferably in approximately the same horizontal plane as the first curtain rod 23, and spaced from the first curtain rod 23 in the manner illustrated in FIG. 2. Then the eyelets 37 are slid along slot 42 into the appropriate position along the length of the curtain rod 40, each eyelet means 37 being in alignment with a column of rings 17–21.

Assuming that the user wishes the shade 12 to be raised from the left hand side (as viewed in FIG. 1), the second ends of the cords 27–31 are passed through the eyelets defined by the looped portions 52 of the eyelet means 37 in the manner illustrated in FIG. 2. That is the cord 27 passes through all five eyelet means 37, the cord 28 through four, the cord 29 through three, the cord 30 through two, and the cord 31 through one. The reverse would be true if it were desirable to have the shade 12 raised from the right hand side.

Once all of the cords 27–31 have been threaded through the eyelet means 37, the free ends 35 thereof are tied together in a knot (see FIG. 2) so that the free ends 35 are positioned near, or slightly above, the cleat 38.

To raise the shade 12, with a ballooning effect, one merely pulls on the collective cord ends 35, causing the bottom 14 of the shade 12 to move toward the top 13 any desired degree, to achieve a ballooning effect as illustrated in FIG. 1. When the desired position of the shade 12, and ballooning effect, are achieved, the cords 27–31 adjacent the collective ends 35 thereof are wrapped around the cleat 38 to hold the shade 12 in place.

Operation for the FIGS. 7–9 embodiment in generally the same. The screw 78 being loosened to position the eyelets 37' approximately along the length of the rod 40', and tightened when the selected positions are reached.

It will thus be seen that according to the present invention a simple and effective balloon shade assembly, and a combination of a curtain rod and eyelet means, have been provided. While the invention has been herein shown and desired in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. In combination with a curtain rod which comprises an elongated tubular member:

an eyelet means adapted to operatively cooperate with a curtain, drape or, shade, said eyelet means comprising: a body member forming a closed loop static eyelet for receipt of a cord and adapted to be disposed exteriorly of said curtain rod; a holding member, distinct from said body member, and operatively engaging said curtain rod; and fastener means operatively attaching said body member and said holding member to said curtain rod in a selected position to which they have been moved along said curtain rod;

said elongated tubular member having a front wall, a back wall having a front surface and a rear surface and being spaced from the front wall, means defining a slot in the back wall extending in the direction of elongation of the tubular member, and an interior volume between the front and back walls;

said eyelet forming body member being in contact with the front surface of said back wall;

said holding member disposed within said interior volume and adapted to engage the rear surface of said back wall;

said holding member comprising a sheet metal nut, and said fastener means comprising a screw fastener;

said sheet metal nut curved about an axis extending through a central portion thereof, and having a rectangular shape; and wherein said body member comprises an integral piece of material including first and second aligned end portions, with aligned openings therein adapted to receive said fastener, and a central portion formed into a loop.

2. A combination as recited in claim 1 wherein said body member is an integral piece of plastic.

3. A combination as recited in claim 1 wherein said holding member comprises a circumferentially continuous member having a through-extending cavity having a shape corresponding to that of the curtain rod and dimensions slightly greater than that of the curtain rod so that said holding member may slide as a sleeve over said curtain rod.

4. A combination as recited in claim 3 wherein said eyelet forming body member and holding member comprise an integral piece of plastic the eyelet forming body member comprising a distinct portion of said holding member.

5. A combination as recited in claim 4 wherein said fastener means comprises a screw fastener passing through an interiorly threaded opening in a portion of said holding member, to engage the exterior surface of said curtain rod to frictionally hold said holding member in place along said curtain rod.

6. A balloon shade assembly comprising:

a sheet of fabric having a front side and a back side, a top, and a bottom;

a plurality of rings disposed in columns on the back of said fabric sheet;

means formed at the top portion of said fabric sheet for connection to a curtain rod;

a plurality of cords, each operatively connected at one end thereof to a portion of said fabric sheet adjacent said bottom, and passing from the point of operative connection through the rings in a column, and having a second free end thereof extending above the top ring in the column;

a first curtain rod operatively connected to said means formed at the top portion of said fabric sheet, for supporting said fabric sheet at said top portion; and a second curtain rod spaced from said first curtain rod and in operative association with said cords so that said second ends of said cords may be acted upon to effect movement of said fabric sheet bottom toward said fabric sheet top and a ballooning effect of said fabric sheet.

7. An assembly as recited in claim 6 wherein said second curtain rod comprises an elongated tubular member having a front wall, a back wall having a front surface and a rear surface, with means defining an elongated slot in said back wall, the slot elongated in the direction of elongation of said tubular member, and an interior volume disposed between said front wall and said back wall; and a plurality of static structure eyelets disposed in operative association with said second curtain rod and exterior of said second curtain rod interior volume, and each cord passing through one or more of said eyelets adjacent said second ends of said cords.

8. An assembly as recited in claim 7 wherein said eyelets each comprise: an eyelet forming body member disposed exteriorly of said interior volume and in engagement with the front surface of said back wall of said second curtain rod; a holding member disposed within said interior volume and engaging the rear surface of said back wall of said second curtain rod; and fastener means extending between said body member and said holding member for attaching said body member and holding member together, and for effecting selective stationary positioning of said body member at a predetermined desired position along the length of said second curtain rod.

9. An assembly as recited in claim 8 wherein said holding member comprises a sheet metal nut having a rectangular shape, and wherein said fastener means comprises a screw fastener.

10. An assembly as recited in claim 6 further comprising a plurality of static structure eyelets disposed in operative association with said second curtain rod and having the eyelet portion thereof exterior of the curtain rod, and each cord passing through one or more of said eyelets adjacent said second ends of said cords.

11. An assembly as recited in claim 10 wherein each of said eyelets comprises a body member forming a closed loop eyelet for receipt of a cord, and adapted to be disposed exteriorly of said curtain rod; a holding member comprising a substantially circumferentially continuous member defining a through-extending internal cavity having a shape comparable to that of the exterior shape of the second curtain rod, and having dimensions slightly greater than the external dimensions of said second curtain rod so that said holding member may slide as a sleeve over said second curtain rod; and further comprising fastener means operatively attaching said body member and said holding member to said second curtain rod in a selected position to which they have been moved along said second curtain rod.

12. An assembly as recited in claim 11 wherein said body member and said holding member comprise an integral piece of plastic, said body member being a distinct portion of said integral piece of plastic; and wherein said fastener means comprises a screw fastener passing through an interiorly threaded through-extending opening in said holding member, to frictionally engage the exterior surface of said second curtain rod.

13. A balloon shade assembly comprising:

a sheet of fabric having a front side and a back side, a top, and a bottom;

a plurality of rings disposed in columns on the back of said fabric sheet;

means formed at the top portion of said fabric sheet for cooperation with a supporting member;

a plurality of cords, each operatively connected at one end thereof to a portion of said fabric sheet adjacent said bottom, and passing from the point of operative connection through the rings in a column, and having a second free end thereof extending above the top ring in the column, and a curtain rod, distinct from said means formed at the top portion of said fabric sheet, having a plurality of eyelet means associated therewith, each of said eyelet means comprising a closed loop eyelet receiving one or more of said cords therein adjacent the second ends of said cords, so that upon a pulling force being exerted on said second ends of said cords said bottom of said fabric sheet will move towards said top thereof, and there will be a ballooning effect of said fabric sheet.

14. An assembly as recited in claim 13 in combination with a cleat stationarily mounted with respect to said curtain rod, and below said curtain rod, and in operative association with said second ends of said cords so that they may be fastened to said cleat to hold said fabric sheet so that it has a ballooning effect.

15. An assembly as recited in claim 13 wherein said curtain rod comprising an elongated tubular member having a front wall, a back wall having a rear surface and spaced from the front wall, means defining a slot in the back wall extending in the direction of elongation of said tubular member, and an interior volume between said front and back walls; and wherein said eyelets each comprise: a body member forming a closed loop static eyelet for receipt of a cord disposed exteriorly of said interior volume in an engagement with the front surface of said curtain rod back wall; a holding member disposed within said interior volume and engaging the rear surface of said back wall of said curtain wall; and fastener means extending between said body member and said holding member for attaching said body member and holding member together, and for effecting selective stationary positioning of said body member at a predetermined desired position along the length of said second curtain rod.

16. An assembly as recited in claim 13 wherein each of said eyelets comprises a substantially circumferentially continuous holding member having a through-extending cavity therein having a shape corresponding to the exterior configuration of said curtain rod, and having dimensions slightly greater than the dimensions of said curtain rod so as to slide as a sleeve over said curtain rod; a body member forming a closed loop eyelet for receipt of a cord, and attached to said holding member and extending outwardly therefrom as a distinct portion thereof; and a screw fastener passing through an internally threaded opening in said holding member to frictionally engage said curtain rod.

* * * * *